United States Patent [19]

Beaver

[11] 4,257,731

[45] Mar. 24, 1981

[54] POWERED IMPLEMENT WITH WORK ELEMENTS PIVOTALLY MOUNTED ON AN IMPLEMENT MOUNTING AND A TORQUE TUBE FOR ROTATING SUCH MOUNTING

[75] Inventor: Robert Beaver, Coos Bay, Oreg.

[73] Assignee: North Bend Fabrication & Machine, Inc., North Bend, Oreg.

[21] Appl. No.: 942,398

[22] Filed: Sep. 14, 1978

[51] Int. Cl.[3] ..... B66C 3/00

[52] U.S. Cl. ..... 414/694; 294/70; 294/88; 414/705; 414/739

[58] Field of Search ..... 414/624, 625, 626, 694, 414/726, 739, 705; 294/70, 88; 37/183-188

[56] References Cited

U.S. PATENT DOCUMENTS

| | | | |
|---|---|---|---|
| 2,337,133 | 12/1943 | Strain | 37/187 X |
| 2,910,274 | 10/1959 | Scott | 294/70 X |
| 3,451,150 | 6/1969 | Pitaval | 294/70 |
| 3,517,960 | 6/1970 | Mork et al. | 294/70 |
| 3,786,827 | 1/1974 | Berg | 37/184 X |
| 3,881,263 | 5/1975 | Coeurderoy | 294/70 X |
| 3,902,614 | 9/1975 | Roberts et al. | 294/88 X |

*Primary Examiner*—Leslie J. Paperner
*Attorney, Agent, or Firm*—Kolisch, Hartwell & Dickinson

[57] ABSTRACT

A power-operated implement mechanism mounted on the tip of a boom. The mechanism includes a torque tube which is rotated under power to rotate an implement mounting. A fluid-operated ram which is actuated to cause opening and closing of work implements in the mechanism has its rod extending downwardly through the torque tube then to be connected through linkage to the work implements. The work implements are pivotally mounted on the implement mounting. The implement mounting is rotated about the axis of the torque tube through power-operated means operatively connected to the torque tube.

6 Claims, 4 Drawing Figures

POWERED IMPLEMENT WITH WORK ELEMENTS PIVOTALLY MOUNTED ON AN IMPLEMENT MOUNTING AND A TORQUE TUBE FOR ROTATING SUCH MOUNTING

BACKGROUND AND SUMMARY OF THE INVENTION

This invention relates to power-operated implement mechanism of the type that may be mounted on the tip of a boom such as the boom found in the conventional backhoe.

The mechanism may include opposed work implements, such as the buckets found in a power-operated clam. The work implements are pivotally supported on an implement mounting. The implement mounting is rotatable a full 360° about an axis which is normally upright, for the purpose of positioning the buckets in the clam. The mechanism further may be tilted, about an axis extending transversely of the boom tip which mounts it, for the purpose of producing a reach in the mechanism.

Implement mechanisms including work implements such as the buckets found in a clam have been known in the past. Mechanisms of this type which have been proposed to date have been subject to a number of disadvantages. Many, for instance, require flexible hose lines for the supply and exhaust of pressure fluid used to operate the mechanism, and these hose lines tend to wrap around the mechanism with rotation of the mechanism, which has the effect of limiting the amount of rotation permitted in the mechanism. Such hose lines, and fluid-operated means, such as a fluid-operated ram provided for the actuation of the device, frequently are found in a relatively exposed position, rendering them susceptible to damage. Another characteristic of many prior art devices is a rather cumbersome structure for mounting the work implements, e.i. the clam buckets, which has tended to limit maneuverability in the mechanism. In many constructions the support provided for operating parts is inadequate, so that full loading of one or both of the buckets in the mechanism may not be performed without a tendency for bending and wear to occur in operating parts involved.

Generally, an object of this invention is to provide an improved power-operated implement mechanism which takes care of the above-indicated deficiencies in a highly practical and satisfactory manner.

Another object is to provide such a mechanism wherein the mounting for work implements therein may be rotated about a full 360° angle without any limitation imposed by reason of hydraulic lines present.

Another object of the invention is to provide an implement mechanism which features a fluid-operated ram which is actuated to actuate work implements in the mechanism, such ram having a rod concentric with and extending through the interior of a torque tube which is utilized in producing rotation of the mechanism.

Yet another object of the invention is to provide an implement mechanism which features an implement mounting pivotally mounting work implements such as the buckets found in a clam, a torque tube joined to this mounting which is rotated about its axis to rotate the implement mounting, and a fluid-operated ram including a cylinder and piston which is actuated to actuate the work implements, the rod in such ram extending through the torque tube to a linkage system which is connected to the work implements.

Yet another object of the invention is to provide implement mechanism of the above general description wherein the torque tube and ram cylinder are supported on a casing, with the casing being provided with means for pivotally supporting it on the tip of a boom, such as the boom found in a backhoe.

These and other objects and advantages are obtained by the invention, which is described herein below in conjunction with the accompanying drawings, wherein.

Figure 1:
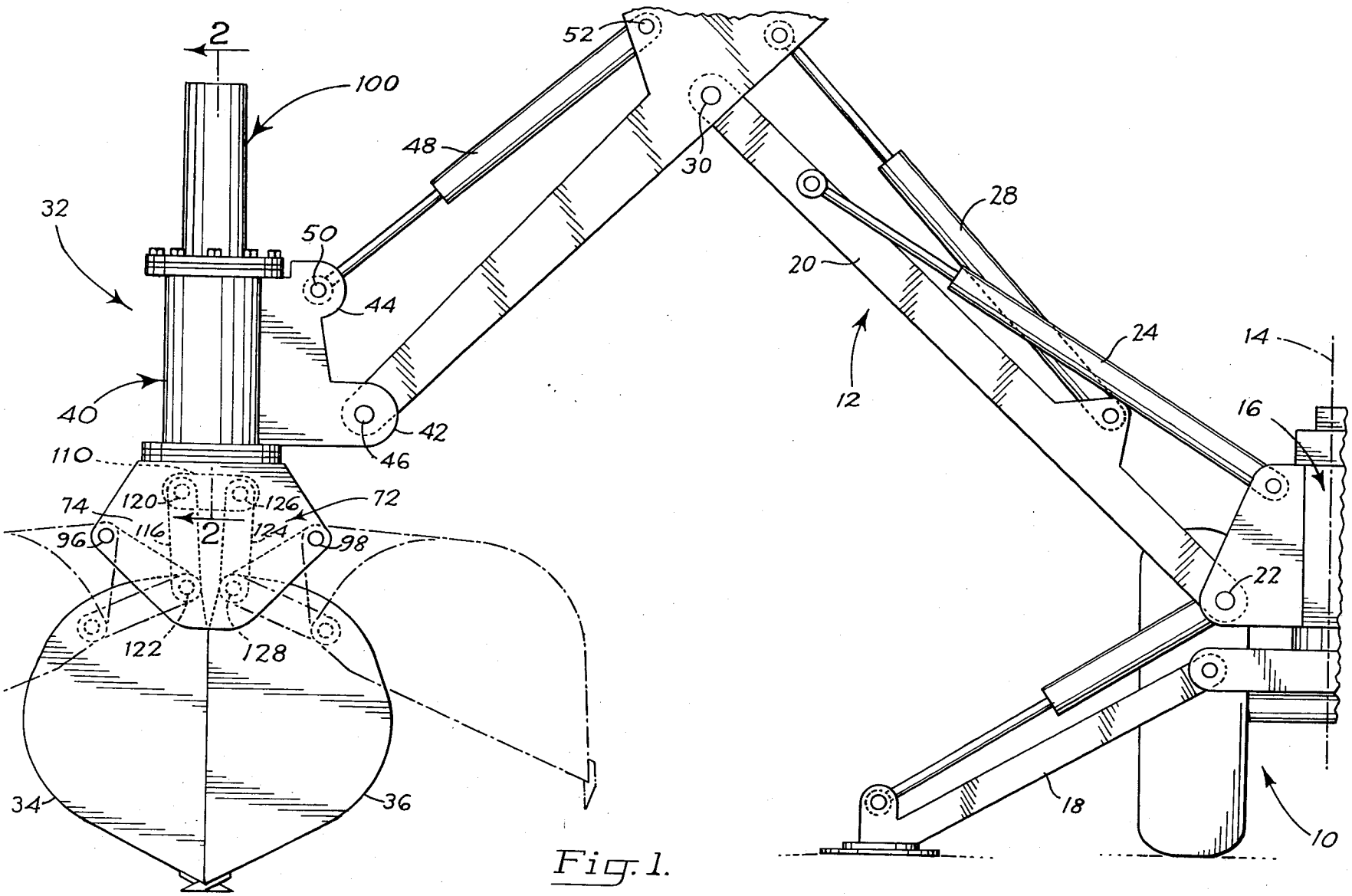
FIG. 1 illustrates portions of a vehicle equipped with a boom such as is found in a backhoe, the tip of such boom supporting implement mechanism constructed according to a preferred embodiment of the invention.

Referring now to the drawings, and more particularly to FIG. 1, portions of a vehicle such as a tractor are shown at 10. The vehicle mounts an articulated boom 12 of the type that is conventionally utilized with a so-called backhoe. The boom is mounted for swivel movement about an upright axis 14, by swivel means 16, which conventionally includes means for producing such movement under power, thereby to change the angle at which the boom extends out from the tractor. An outrigger stabilizing the vehicle is shown at 18.

Boom 12 includes a base section 20 pivoted as 22 to swivel means 16. A ram 24 extending from the swivel means to the base section is adjusted in length to change the angle of elevation of base section 20. Shown at 26 is a tip section in the boom, and a ram 28 interposed between the base and tip sections is adjustable in length to change the angular position of the tip section relative to the base section. The tip section is pivotally mounted on the base section at 30.

Mounted on the end of tip section 26 is what is referred to herein as an implement mechanism generally indicated at 32. The mechanism includes a pair of opposed work implements, more specifically clam buckets 34, 36, forming what is commonly referred to as a clam, carried at the base of the mechanism and utilized for digging purposes. The implement mechanism further includes a casing structure 40 which presents at one side of the casing structure ear portions 42, 44. Pivot means 46 pivotally mounts ear portion 42 on the end of the boom tip section. This pivot means mounts the casing section, and the remainder of the implement mechanism, for pivotal movement about a generally horizontal axis, thereby to enable a change in the reach of the implement mechanism. Such pivotal movement is produced by actuation of a ram 48 having its rod end pivotally connected to ear portion 44 by pivot means 50 and its cylinder end pivotally mounted at 52 to the tip section.

Figures 2, 3, 4:
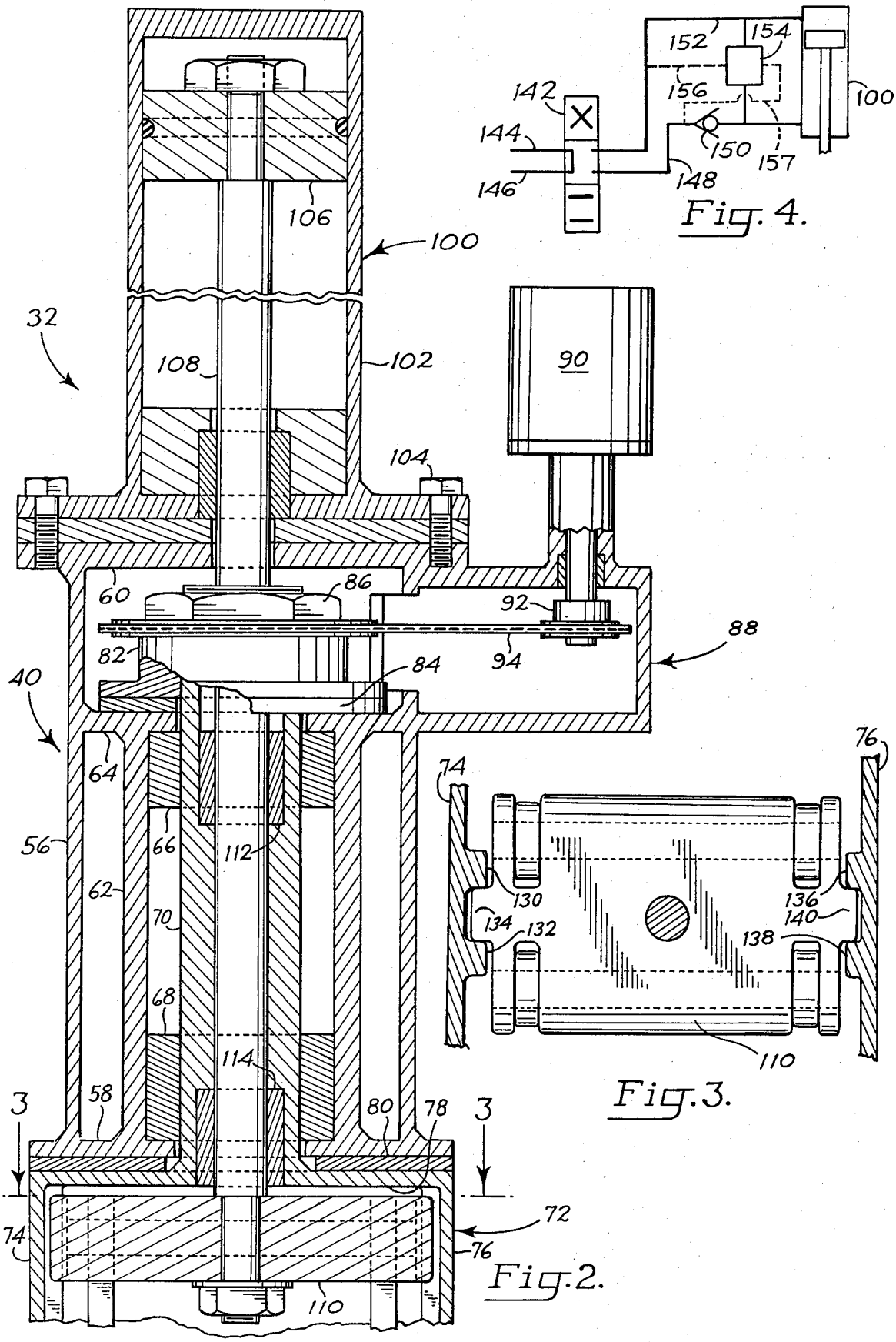
FIG. 2 is a cross-sectional view, on a somewhat larger scale, taken generally along line 2—2 in FIG. 1, and illustrating in more detail operating parts of the mechanism.
FIG. 3 is a cross-section view, taken generally along the line 3—3 in FIG. 2.
FIG. 4 is a schematic drawing illustrating the pressure fluid system used in the supply and exhaust of pressure fluid for a ram which actuates work implements in the device.

Referring now additionally to FIGS. 2 and 3, casing structure 40 includes an outer cylinder 56 and end plates 58, 60 secured to the ends of this outer cylinder. Within this outer cylinder is an inner cylinder 62 with its bottom end secured to plate 60 and its top end secured to a plate 64. Plate 64 is also joined to outer cylinder 56.

Journaled within inner cylinder 62, by means of an upper bearing 66 and a lower bearing 68, is what is referred to herein as a torque tube 70. The torque tube is utilized to rotate the mounting for clam buckets 34, 36 about an axis coinciding with the axis of the torque tube.

More specifically, clam buckets 34, 36 are supported on what is referred to herein as an implement mounting 72 which includes opposed side expanses 74, 76 and top expanse 78. The base of the torque tube is joined to top expanse 78. Interposed between the top expanse and plate 58 of the casing structure is a thrust washer 80.

A sprocket element 82 encircles the top portion of the torque tube and such is keyed to the torque tube whereby the two rotate as one. Interposed between the sprocket element and plate 64 is a thrust washer 84. Holding the assembly together is a nut 86 screwed onto an externally threaded upper end portion of the torque tube.

The casing structure adjacent the top of cylinder 56 includes an outwardly projecting housing portion 88. The top of such housing portion supports a hydraulic motor 90 having its output shaft drivingly connected through a sprocket 92 and chain 94 to sprocket element 82 and the torque tube. Operation of motor 90 in one direction operates to turn the torque tube and swivel the implement mounting in one direction, about the axis of the torque tube, and reverse swivel movement is produced by reverse operation of the motor.

The clam buckets are pivotally mounted on the implement mounting by pivots 96, 98. Powered movement of the clam buckets to swing them apart or bring them together is produced by actuation of a ram 100.

More specifically, a cylinder 102 of the ram is secured to the casing structure through fasteners 104 securing it to plate 60. The ram includes a piston 106 and rod 108. The rod extends downwardly through the casing and interior of the torque tube, and has its lowered end secured to a crosspiece 110 disposed within the implement mounting. Supporting the rod where such passes through the torque tube are bushings 112, 114.

Each end of the crosspiece is link-connected to the clam buckets. Thus, as is probably best evident in FIG. 1, the end of the crosspiece illustrated is connected by link 116 to bucket 34, the link being pivotally connected to the crosspiece at 120 and to the bucket at 122. Link 124 connects the crosspiece and bucket 36, this link being pivoted to the crosspiece at 126 and the bucket at 128. A similar set of links is provided linking together the crosspiece and the buckets at the opposite end of the crosspiece.

The crosspiece is guided for vertical reciprocal movement in the implement mounting. Thus, as is probably best evident in FIG. 3 side expanse 74 has guide ridges 130, 132 extending downwardly along the inside thereof defining a channel therebetween which receives a protrusion 134 projecting out from the crosspiece. Similar guide ridges 136, 138 are found along the inner side of side expanse 76 which guide protrusion 140 of the crosspiece.

A regenerative hydraulic system is provided for powering ram 100 which actuates the clam buckets. Thus, and with reference to FIG. 4, 142 is a control valve, connected to pressure and return lines 144, 146 of a fluid supply, and controlling the supply and exhaust of pressure fluid to ram 100. Conduit 148 including check valve 150 connects with the bottom end of the ram and conduit 152 connects with the top end of the ram. Interposed between conduits 148, 152 is a normally closed pilot-operated valve 154 controlled by pilot lines 156, 157. The ram is extended through adjustment of valve 142 to supply pressure fluid to conduit 152 which pressure fluid is admitted to the top end of the ram. With pressure fluid in conduit 152, pilot-operated valve 154 opens, and fluid which exhausts from the bottom of the ram through ram extension returns to the top end of the ram through now open pilot valve 154. In this way relatively rapid extension of the ram is produced, with fast opening of the clam buckets. To produce contraction of the ram and closing of the buckets, pressure fluid is admitted into conduit 148 and the bottom of the ram. Pilot-operated valve 154 closes. Fluid exhausted from the top of the cylinder returns to the supply through conduit 148. The ram contracts at a somewhat slower speed than it extends, but with a greater force exerted on the clam buckets.

Explaining now the operation of the implement mechanism, and with reference to FIG. 1, operation of the boom serves to put the mechanism at the desired location relative to the vehicle. The attitude of the mechanism is controlled by making proper adjustments in the length of ram 48. The implement mounting which supports the clam buckets may be rotated a full 360° about the axis afforded by the torque tube, which is the center axis of the casing illustrated. Such is performable without entanglement of hydraulic lines, since the hydraulic motor is mounted on the casing and the casing does not take part in rotative movement. Closing and opening of the buckets is produced by contraction and extension of the ram 100. This cylinder is supported on top of the casing structure, and its rod extends downwardly through the interior of the torque tube to a connection with the crosspiece which is linked to the clam buckets.

The implement mechanism disclosed can dig close to walls or buildings as well as in high embankments, and is capable of loading high trucks, etc., without spillage. The mechanism can be used to dig straight down, in digging a hole or shaft which has a cross-section determined by the area encompassed by the buckets with such extended. When the buckets in the implement mechanism are closed under full pressure, the lower thrust washer functions as a break for the implement mounting. When pressure is slightly dropped off, the implement mounting is released from this breaking action. The thrust washers are designed to carry extreme loads. The sprockets, chain and motor are out of the way, and are protected from damage. The two widely spaced bushings supporting the piston rod within the torque tube, and the guide system provided for the cross-member which is secured to the bottom end of the piston rod, allow for one bucket to take full loading without bending or distortion of the rod. Loading of the buckets tends to produce compression in the parts, which reduces strain and contributes to less wear and longer life. While a very practical mechanism is disclosed, the mechanism is relatively economical to manufacture, and easy to repair and maintain.

While an embodiment of the invention has been disclosed, it is appreciated that variations and modifications are possible without departing from the invention.

It is claimed and desired to secure by letters patent:

1. Power-operated implement mechanism comprising: a casing structure including a base, an implement mounting adjacent the base of said casing structure, thrust bearing means between the base of said casing structure and said implement mounting, a torque tube rotatably mounted in said casing structure joined to said mounting, a fluid-operated ram including a cylinder mounted on said casing structure, said ram further including a piston rod extending through said torque tube, first and second bearing means rotatably supporting said rod in said torque tube, positioned adjacent upper and lower ends, respectively, of said torque tube, a work implement pivotally mounted on said mounting, a linkage system interconnecting the bottom end of said rod and said work implement, and means for rotating said torque tube including motor means mounted on said casing structure.

2. The implement mechanism of claim 1 wherein said implement mounting has a top expanse and opposed depending side expenses joined top said top expanse, and which further includes another work element which is pivotally mounted on said implement mounting, said other and said first-mentioned work element having opposed positions on said mounting, said linkage system including a cross-member joined to the piston rod and links connecting said cross-member and opposed work elements whereby on downward movement of the piston rod the work elements are swung away from each other, said side expanses of the implement mounting having means on the inner sides thereof defining channels which guide said cross-member for vertical reciprocal movement.

3. Power-operated bucket mechanism comprising:

casing structure, a torque tube rotatably mounted in the casing structure, an implement mounting adjacent the base of the casing structure joined to the torque tube for rotation therewith, said implement mounting having a top expanse and opposed depending side expanses joined to said top expanse, a ram including a cylinder mounted on said casing structure which ram includes a rod extending through said torque tube, first and second bearing means rotatably supporting said rod in said torque tube, positioned adjacent upper and lower ends, respectively, of said torque tube, opposed clam elements pivotally mounted on said side expanses of said implement mounting, a cross-member secured to the bottom end of said rod, said implement mounting having means forming channels on the inner sides of said side expanses which guide said cross-member for vertical reciprocal movement, links interconnecting said cross-member and said buckets whereby on downward movement of said rod said clam buckets pivot outwardly on said pivot means, and power-operated means for rotating said torque tube.

4. The mechanism of claim 3, in combination with a vehicle-mounted boom, said casing structure being pivotally mounted on the tip of said boom.

5. The mechanism of claim 3, wherein said casing structure has a base, and which further includes thrust means interposed between the base of said casing structure and said implement mounting.

6. The bucket mechanism of claim 5, which further includes a pressure fluid system for supplying fluid under pressure to said ram and wherein said pressure fluid system is regenerative whereby the rod is caused to be moved upwardly into said cylinder at a slower speed and with a greater force than when the rod is moved downwardly out of said cylinder.

* * * * *

UNITED STATES PATENT AND TRADEMARK OFFICE

CERTIFICATE OF CORRECTION

PATENT NO. : 4,257,731

DATED : March 24, 1981

INVENTOR(S) : ROBERT BEAVER

It is certified that error appears in the above-identified patent and that said Letters Patent are hereby corrected as shown below:

In column 5, line 22, delete "top" first occurrence and insert --to--.

Signed and Sealed this

*Twentieth* Day of *October 1981*

[SEAL]

*Attest:*

GERALD J. MOSSINGHOFF

*Attesting Officer*

*Commissioner of Patents and Trademarks*